United States Patent [19]

Seto et al.

[11] 4,401,544

[45] Aug. 30, 1983

[54] COMPOSITE ELECTRODES FOR DIAPHRAGMLESS ELECTROLYTIC CELLS FOR THE PRODUCTION OF CHLORATES AND HYPOCHLORITES II

[75] Inventors: Kin Seto; Ian H. Warren, both of Vancouver, Canada

[73] Assignee: C-I-L Inc., North York, Canada

[21] Appl. No.: 268,742

[22] Filed: Jun. 1, 1981

[30] Foreign Application Priority Data

Jun. 10, 1980 [CA] Canada ..... 353846

[51] Int. Cl.[3] ..... C25B 11/02; C25B 11/10

[52] U.S. Cl. ..... 204/288; 204/290 R; 204/290 F; 204/293; 204/289

[58] Field of Search ..... 204/286–288, 204/289, 292, 293, 294, 290 F, 290 R, 267–270, 95

[56] References Cited

U.S. PATENT DOCUMENTS

| | | | |
|---|---|---|---|
| 2,868,712 | 1/1959 | Deprez | 204/288 |
| 3,055,821 | 9/1962 | Holmes et al. | 204/278 X |
| 3,598,715 | 8/1971 | Goens et al. | 204/288 X |
| 3,759,815 | 9/1973 | Larsson | 204/288 X |
| 4,132,622 | 1/1979 | Kenney | 204/288 X |

*Primary Examiner*—Donald R. Valentine
*Attorney, Agent, or Firm*—C. Brian Barlow

[57] ABSTRACT

A composite electrode made up by stacking a multiplicity of alternate anode plates and cathode plates the adjacent surfaces of which are insulated from each other by a thin film of an insulating material such as fluon, kynar, PVC, etc. With this composite electrode, a K value of 0.100 to 0.150 can be easily achieved in the electrolytic production of chlorates and hypochlorites.

5 Claims, 3 Drawing Figures

COMPOSITE ELECTRODES FOR DIAPHRAGMLESS ELECTROLYTIC CELLS FOR THE PRODUCTION OF CHLORATES AND HYPOCHLORITES II

This invention relates to diaphragmless electrolytic cells for the production of alkali metal chlorates and hypochlorites and is more particularly concerned with a novel composite electrode assembly for use in such cells.

In diaphragmless electrolytic cells for the production of chlorates and hypochlorites, the conventional arrangement of electrodes consists of anode plates and cathode plates disposed in parallel face to face relationship with a gap in between for electrolyte circulation and generated gas evolution. The overall electrical energy required for the efficient operation of these conventional cells represents a very significant component of the total production costs and it has long been realized by those versed in the art that even small reductions in overall cell voltage may be commercially important.

It is known that the electrical pressure or voltage necessary to effect electrolysis in these cells is in proportion to the resistance of the cell components and contents to the flow of current from the anode to the cathode. It is also known that a major portion of the total cell voltage drop caused by said resistance is contributed by the electrolyte in the gap between the anode and the cathode. Therefore in attempts at reducing the voltage drop, much work has been done towards finding ways of reducing the gap width and thus the thickness of electrolyte between the anode and the cathode. It has soon been realized, however, that the gap width can be reduced only to a certain limit under which a problem occurs in the release or free evolution of generated gas, especially in cells having high electrodes and operating at high current density. Indeed gas generated during electrolysis has a tendency to accumulate in a gap that is too narrow and causes high electrical resistance which in turn contributes to high cell voltage. The voltage drop in any cell can be assessed through its K factor which is a measure of the total resistance of the cell and represents the slope obtained by plotting the cell voltage against the current density. The steeper the slope, the higher is the K factor and the higher is the voltage drop. For the conventional commercial chlorate cells using metal electrodes, the normal range of the K factor is from 0.250 to 0.350 $m\Omega M^2$.

It is an object of this invention to provide a particular electrodes assembly for use in diaphragmless electrolyte cells whereby the latter have a K factor as low as 0.100 $m\Omega M^2$.

The electrode assembly of the present invention comprises:

(a) first and second base plate disposed in parallel relationship at a distance from each other;

(b) at least one row of equidistantly spaced aparts finger-like metal cathodes projecting from the first base plate in the direction of but short of the distance to the second base plate, the cathodes in each row being in a same plane essentially perpendicular to the base plates; and (c) for each row of finger-like metal cathodes, a corresponding coplanar row of finger-like metal anodes projecting from the second base plate in the direction of but short of the distance to the first base plate;

and is characterized in that the anodes and cathodes of corresponding coplanar rows of anodes and cathodes are interdigitated and are insulated from each other by a thin layer of a non-electrically conductive insulating material.

The first and second base plates are essentially support plates for the electrodes projecting therefrom and can be made of any suitable material. Preferably said plates are made of the same metal as that of their respective supported electrodes.

The finger-like anodes and cathodes are generally identical in shape and should offer flat longitudinal side surfaces which afford close fit in interdigitation. Preferably they should be rectangular or square in transverse cross-section.

The anodes can be made of any valve metal coated with a protective metal or metal oxide e.g. rutile coated titanium or zirconium. Preferably the anodes are made of titanium coated with a noble metal of the platinum group or an oxide thereof. The cathodes can also be made of titanium or coated titanium but preferably are made of a mild steel such as stainless or carbon steel.

As is clearly indicated above, the anodes and cathodes projecting from their respective base plates are disposed in aligned rows so that they can be interdigitated and from a succession of spaced apart stacks of anodes and cathodes. In a cell, the stacks form the electrodes and the spaces between successive stacks are for circulation of electrolytyte and products of electrolysis. The main aspect of this invention resides in the feature whereby the anodes and cathodes in the stacks are insulated from each other by a thin layer of insulating material. As an insulating material there can be used any material which is electrically non-conductive and can be deposited on the surfaces of the anodes and/or cathodes which are adjacent to each other in any suitable manner such as by spray coating, painting or laying in the form of a thin preformed film. The insulating material may be deposited on the anode or the cathode or both. Examples of insulating materials suitable for use in the invention are ceramics, silicone rubber and non-electrically conductive plastic polymeric materials. Preferred are polytetrafluoroethylene, polychlorotrifluoroethylene, polyvinyl chloride and polyvinylidene fluoride.

The base plates, anodes and cathodes including the insulating material forming the electrode assembly of the invention can be fastened together in any conventional means such as with clamps, bolts and nuts, slotting with tight fitting or preferably by welding.

The invention may be better understood with reference to the accompanying drawing in which.

Figure 1:
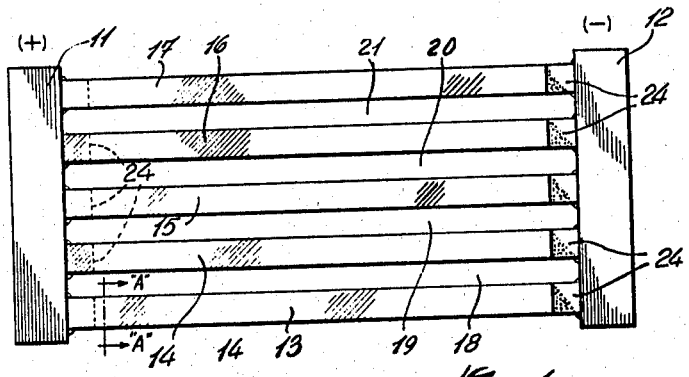
FIG. 1 is a plan view of one embodiment of the electrode assembly of the invention.
Figure 2:
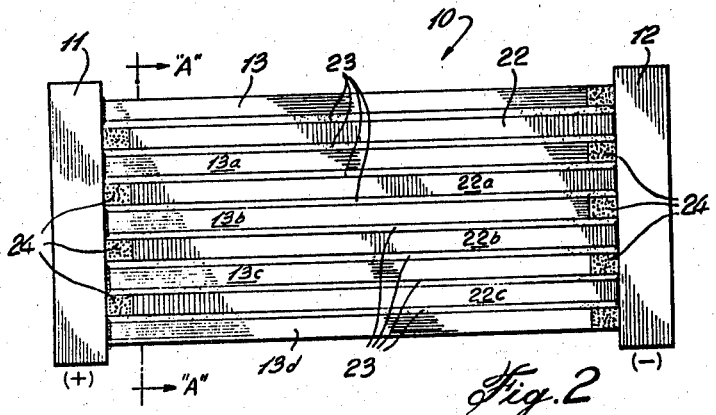
FIG. 2 is a view in elevation of the same embodiment.

Referring to FIGS. 1 and 2 there is shown an electrode assembly 10 involving two base plates 11 and 12 dispersed in parallel relationship at a distance from each other. Projecting from base plate 11 in the direction of but short of the distance to base plate 12 there are finger-like metal anodes disposed in five equidistantly spaced apart rows in parallel planes essentially perpendicular to the base plates. FIG. 1 being a plan view only the top anode of each of the five rows can be seen and such top anodes are designated by reference numerals 13, 14, 15, 16 and 17 which the spaces between the rows appear as 18, 19, 20 and 21. The latter are of course for circulation of electrolyte and products of electrolysis.

Referring now to the elevation view of FIG. 2, it is shown that each row of anodes comprises five anodes only the row of anodes 13, 13*a*, 13*b*, 13*c* and 13*d* being seen. Also shown in FIG. 2 there are finger-like metal cathodes projecting from base plate 12 in the direction of but short of the distance to base plate 11. Such cathodes are also disposed in five rows only one of which appears under reference numerals 22, 22*a*, 22*b* and 22*c*, disposed in the same planes as the five rows of anodes. Each row of cathodes thus comprises four finger-like cathodes which interdigitate with the five finger-like anodes of a corresponding row of anodes. Disposed between the adjacent sides of interdigitating anodes and cathodes there are thin layers 23 of an insulating material which does not conduct electricity.

Figure 3:
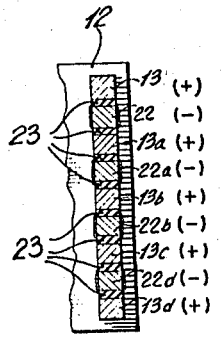
FIG. 3 is a cross-sectional view along the lines A—A of FIGS. 1 and 2.

With the arrangement described above, there is thus obtained an electrode assembly comprising between base plates 11 and 12 comprising five stacks one on which is best shown in FIG. 3 in which finger-like anodes and cathodes alternate and are electrically insulated from each other.

Of course the invention is not limited to the specific embodiment illustrated in the drawing. For instance the number of rows of finger-like electrodes can vary widely frome one to as many as is practically and economically suitable. Likewise the number of finger-like electrodes (anodes or cathodes) in each row can also vary widely. Although the electrodes are shown to be square in transverse cross-section it should be understood that they could be also be, for instance, rectangular in transverse cross-section.

Shown in FIGS. 1 and 2 are spacers 24 of an electrically insulating material adapted to prevent the tips of the finger-like anodes and cathodes from contacting base plates 12 and 11 respectively. It should be understood that these spacers 24 are only optional and do not form a feature of the invention.

The invention is illustrated by the following example which is not to be taken as limitative in any way.

EXAMPLE

A cell constructed in accordance with the invention was used to electrolyse an aqueous solution of sodium chloride to produce sodium chlorate. The anodes were made of titanium substrate with a rutile coating and the cathodes were made of carbon steel. A polytetrafluoroethylene film 0.20 mm thick was used as insulating material between the anodes and cathodes. The electrolyte composition and operating conditions were as follows:

| | |
|---|---|
| Temperature | 60° C. |
| pH | 6.2 |
| $NaClO_3$ | 600 g/l |
| NaCl | 110 g/l |
| $Na_2CrO_7$ | 3 g/l |

In operation, the cell voltage at different current densities was found to vary as follows:

| | | |
|---|---|---|
| Current Density | in $KA/m^2$ | 1.00 2.00 3.00 4.00 5.00 6.00 7.00 8.00 |
| Cell Voltage | in V | 2.40 2.71 2.85 3.00 3.15 3.25 3.36 3.52 |

From the above, it clearly appears that within the commercially significant range of current densities of 2.0 to 6.0 $KA/m^2$ (kilo amperes per square meter) the cell has the following K factor:

$$K \text{ factor} = \frac{3.25 - 2.70}{6.00 - 2.00} 0.137\ m\ \Omega\ M^2$$

With a similar range of current densities a conventional cell has a much higher K factor of 0.270 $m\Omega M^2$.

We claim:

1. An electrode assembly for use in diaphragmless electrolyte cells for the production of alkali metal chlorates and hypochlorites comprising:
   (a) first and second base plates disposed in parallel relationship at a distance from each other;
   (b) at least one row of equidistantly spaced apart finger-like metal cathodes projecting from the first base plate in the direction of but short of the distance to the second base plate, the cathodes in each row being in a same plane essentilly perpendicular to the base plates; and
   (c) for each row of finger-like metal cathodes, a corresponding coplanar row of finger-like metal anodes projecting from the second base plate in the direction of but short of the distance to the first base plate;

characterized in that the anodes and cathodes of corresponding coplanar rows of anodes and cathodes are interdigitated and are insulated from each other by a corresponding coplanar thin layer of non-electrically conductive insulating material.

2. An electrode assembly as claimed in claim 1 wherein the insulating material is selected from the group consisting of ceramics, silicone rubber and non-electrically conductive plastic polymeric materials.

3. An electrode assembly as claimed in claim 2 wherein the plastic polymeric material is polytetrafluoroethylene, polychlorotrifluoroethylene, polyvinyl chloride or polyvinylidene fluoride.

4. An electrode assembly as claimed in claim 1, 2 or 3 wherein the cathodes are made of stainless steel or carbon steel and the anodes are made of titanium or zirconium coated with a noble metal of the platinum group or an oxide thereof.

5. An electrode assembly as claimed in claim 1, 2 or 3 wherein the first and second base plates are made of the same metal as that of the electrodes projecting therefrom.

* * * * *